United States Patent [19]

Shin-Tao

[11] Patent Number: 4,759,547

[45] Date of Patent: Jul. 26, 1988

[54] PUZZLE BOARD

[76] Inventor: Chen Shin-Tao, 2nd Fl., No. 66, Wen Lin N. Road, Taipei, Taiwan

[21] Appl. No.: 14,238

[22] Filed: Feb. 12, 1987

[30] Foreign Application Priority Data

Aug. 27, 1986 [TW] Taiwan ..... 75208080

[51] Int. Cl.[4] ..... A63B 67/14; A63F 9/06

[52] U.S. Cl. ..... 273/113; 273/109; 273/153 S

[58] Field of Search ..... 273/153 S, 109, 113, 273/110, 153 R

[56] References Cited

U.S. PATENT DOCUMENTS 656,886 8/1900 Geisel ..... 273/113
785,665 3/1905 Coe ..... 273/109
4,545,577 10/1985 Randleman ..... 273/113

FOREIGN PATENT DOCUMENTS 1012178 6/1977 Canada ..... 273/153 S

*Primary Examiner*—Anton O. Oechsle
*Assistant Examiner*—Gary Jackson
*Attorney, Agent, or Firm*—Lee C. Robinson, Jr.

[57] ABSTRACT

A puzzle board comprises a board having a recess opening at the top side thereof, a plate mounted in the recess and having a plurality of playing piece bearing regions arranged in adjacent rows, playing pieces superimposed slideably on the regions except for one of the regions being left empty to allow the playing pieces to slide on the plate for rearrangement, each of the playing pieces having a groove with an outlet and an inlet. By rearranging the playing pieces, the outlet or inlet of one of the playing pieces can be communicated selectively with the other playing pieces, and a rolling piece received in one of the grooves for moving to a target piece through the intercommunicated grooves.

9 Claims, 2 Drawing Sheets

PUZZLE BOARD

BACKGROUND OF THE INVENTION

This invention relates to a puzzle board, particularly to a puzzle board having playing pieces slideable thereon for rearrangement of grooves provided therein so that desired grooves are intercommunicated selectively to allow a rolling piece to move from one groove to the other as desired until the rolling piece reaches a target place.

Various forms of puzzle toys have existed in the art. One of them is a puzzle board which has a plurality of sliding pieces bearing figures or words, the sliding pieces being arranged in rows and capable of being rearranged again and again by being slid on the board until a proper combination of figures or words is achieved. In another puzzle board, sliding pieces are slid on a board to cause a desired piece to move through a proper path out of the board or to a target place.

SUMMARY OF THE INVENTION

An object of the invention is to provide a novel puzzle board which is more intricate than the above described puzzle boards.

The present invention provides a puzzle board which comprises a board having a recess opening at the top side thereof, a plate mounted in the recess and having a plurality of playing piece bearing regions arranged in adjacent rows, playing pieces superimposed slideably on said regions except for one of the regions being left empty to allow the playing pieces to slide on the plate for rearrangement, each of the playing pieces having a groove with an outlet and an inlet. By rearranging the playing pieces, the groove of one of the playing pieces can be communicated selectively with the groove of the other playing pieces, and a rolling piece received in the groove of one of the playing pieces for moving to a target place through the intercommunicated grooves.

In one aspect of the invention, the puzzle board comprises a board having a first rectangular recess opening at the top side thereof, a second rectangular recess side by side adjacent to the first recess and opening at the top side of the board, a partition separating the first and second recesses and having a first opening communicating a lower part of the first recess and the second recess and a second opening communicating an upper part of the first recess and the second recess, and an inclined face extending in the second recess from the first opening to the second opening.

The rectangular plate is mounted in the first recess to partition the lower and upper parts forming a lower compartment and an upper compartment, and has playing piece bearing regions arranged in adjacent rows and apertures provided in each of the regions to communicate the lower and upper compartments.

The playing pieces include a target piece having a through hole communicating the groove thereof to the lower compartment, whereby the rolling piece can be moved to the lower compartment and returned to the playing pieces through the inclined face.

The playing pieces may be hexahedral and disposed side by side adjacent to each other. The groove of each playing piece is formed in the top side of the playing piece, and the outlet and inlet of each groove are disposed respectively at two adjacent sides of the playing piece. A transparent cover is provided at the top of the board to enclose the playing pieces and the rolling piece.

In another aspect of the invention, the board further comprises a valve means to interrupt the communication between the through hole of the target piece and the lower compartment.

The present exemplary preferred embodiment will be described in detail with reference to the following drawings, in which:

DETAILED DESCRIPTION OF THE PREFERRED EMBODIMENT

Figure 1:
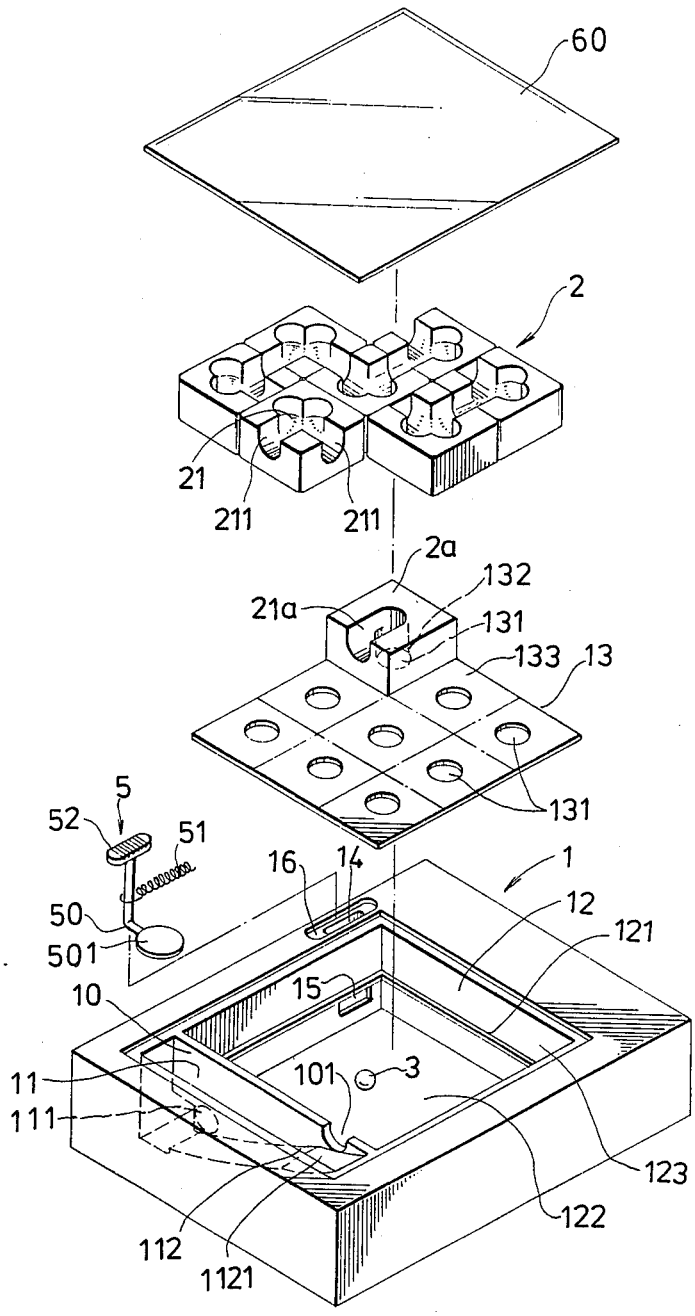
FIG. 1 is an exploded view of the puzzle board according to the preseent invention.

Referring to the drawings, there is shown a puzzle board, having a tray-like board 1 of rectangular cross-section with a recess 12 of square cross-section and a recess 11 of oblong cross-section. A partition 10 is provided to separate the recesses 11 and 12. A mounting ridge 121 projects inwardly from the wall and extends along the four sides of the wall to support a plate 13 which divides the recess 12 into a lower compartment 122 and an upper compartment 123. The lower and upper compartments 122 and 123 are communicated with the recess 11 through an opening 111 and a notch 101 provided in the partition 10.

The plate 13 is rectangular and provided with 3×3 square regions 133 in rows for bearing playing pieces 2. Each region 133 is provided with a circular aperture 131. On one of the regions 133 adjacent one edge of the plate 13 is a fixed playing piece 2a of hexahedral shape which has a groove **21*a* opening at the top and at one side of thereof and a through hole 132 communicating the groove 21*a* and the aperture 131 of the plate 13. Seven playing pieces 2 are superimposed slideably on the other seven regions 133 of the plate 13 so that one region 133** is left as an empty space to allow the playing pieces to change their positions relative to each other for rearrangement.

The playing pieces 2 are disposed side by side adjacent to each other and each of them is a solid body of tetrahedron shape with a groove 21 of substantially L-shape opening at the top side and at two adjacent sides thereof for receiving a rolling piece 3. At the two adjacent sides the groove 21 defines two open ends 211 for admission or discharge of the rolling piece 3. The playing pieces 2 are arranged in such a manner that the groove 21 of each piece 2 can be moved to communicate with a groove 21 of another desired piece 2 by rearranging the pieces 2 on the plate 13.

The rolling piece 3 is received movably in one of the grooves 21 of the playing pieces 2 and is movable from one groove 21 to a desired one of the other grooves 21 by rearranging the playing pieces 2 to cause the two desired grooves 21 to intercommunicate. When the rolling piece 3 reaches the target groove **21*a* of the piece 2*a*, it falls into the lower compartment 122 through the through hole 132 and the aperture 131**.

The aperture 131 below the piece **2*a* is provided with a valve 5 so as to interrupt the communication between the lower compartment 122 and the groove 21*a*. The valve 5 includes a circular valve plate 501 extending into the lower compartment 122 through the opening 15 to block the aperture 131, a L-shaped valve rod 50 connected to the valve plate 501 and movably mounted in a bore 14 of the board 1, a push plate 52 connected to the valve rod 50 and received in a shallow recess 16 to be manually operated by a user, and a spring 51 connected to the valve rod 50 to normally bias the rod 50 to put the valve plate in its closed position. When the push plate 52 is pushed against the action of the spring 51, the aperture 131 is opened and the rolling piece 3 can drop into the lower compartment 122**.

In the recess 11, there is an inclined face 112 extending upward from near the hole 111 to near the notch 101 for allowing the rolling piece 3 to slide upward therealong to return to one of the grooves 21 from the lower compartment 122. The inclined face 112 has a topmost portion 1121 which has a slope smaller than the remaining portion of the inclined face 112. A transparent cover 60 is attached to the top side of the board 1 to enclose the playing pieces 2 and the rolling piece 3.

Figure 2:
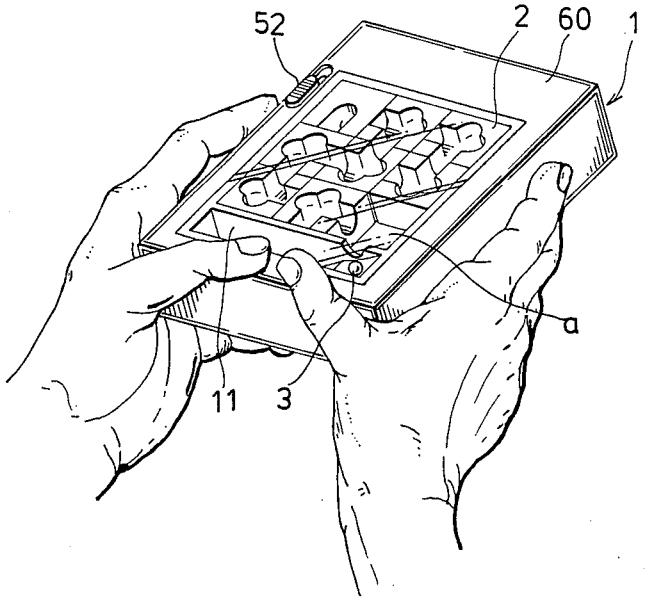
FIG. 2 is a view showing that the puzzle board is manipulated by a player.
Figure 3:
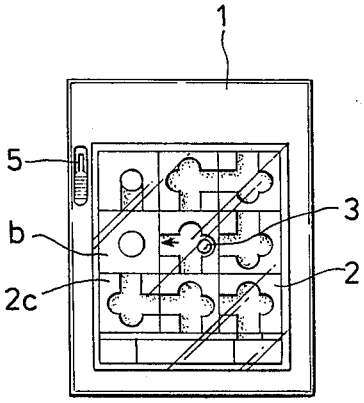
FIG. 3 is a plan view showing playing pieces in a particular arrangement.

The mode of playing the puzzle board 1 will be described hereinafter briefly. As shown in FIG. 2, suppose that the rolling piece 3 is in the recess 11 of the board 1 and the region a is empty before playing. At the begining, the board 1 is inclined downward at its right side to cause one of the sliding pieces 2 at the left side of the empty region a to slide to the empty region a and to cause the rolling piece 3 to reach the face 1121 of the inclined face 112 and enter the groove 21 of that piece 2 through the notch 101. The rolling piece 3 is then moved to the other proper playing pieces 2 one after the other by manipulating the board 1 to cause that playing pieces 2 to intercommunicate in succession until the rolling piece 3 reaches the target groove 21*a*. For example, the rolling piece 3 in a groove 21 adjacent to an empty region b can be moved to the other piece 2, specifically designated by 2*c*, when the piece 2*c* is moved to the empty region b. In this situation, the grooves 21 of the two pieces 2 are intercommunicated and the rolling piece 3 can be moved to the target piece 2*a*. While sliding the playing pieces 2 to the empty region, the player must be careful not to let the rolling piece 3 fall into the aperture 131 of the empty region.

After the rolling piece 3 falls into the lower compartment 122, it can be caused to return to the groove 21 of one of the pieces 2 through the hole 111, the inclined face 112 and the notch 101.

While the puzzle board according to the present invention is described with reference to one having 3×3 intersecting rows and seven movable playing pieces 2, the invention is not limited thereto. The board may have less than or more than 3×3 rows and the number of the playing pieces may be less than or more than seven. Moreover, the pattern of the grooves 21 can be in any other form other than the L shape.

With the invention thus explained, it is apparent that various modifications and variations can be made without departing from the scope of the invention. It it therefore intended that the invention be limited as indicated in the appended claims.

What is claimed is:

1. A puzzle board comprising:

a board having a recess opening at the top side of said board;

a plate mounted in said recess and having a plurality of playing piece bearing regions arranged in adjacent rows, said plate defining a series of apertures, one for each of said regions, for permitting communication between the portion of the recess adjacent one face of said plate with the recess portion adjacent the other face of the plate;

playing pieces superimposed slideably on said regions except for one of said regions being left empty to allow said playing pieces to slide on said plate for rearrangement, each of said playing pieces having a groove with an outlet and an inlet, by rearranging said playing pieces, said outlet or inlet of one of said playing pieces being capable of communicating selectively with said inlet or outlet of another of said playing pieces; and a rolling piece received in said groove of one of said playing pieces and movable from one of said grooves to the other.

2. A puzzle board comprising:

a board having a rectangular recess opening at the top side thereof;

a rectangular plate mounted in said recess intermediate the top and bottom sides of said board to divide said recess into a lower compartment and an upper compartment, and having playing piece bearing regions arranged in adjacent rows an an aperture provided in each of said regions to communicate said lower and upper compartments;

playing pieces superposed on said regions respectively except for one of said regions being left empty to allow said playing pieces to slide on said plate for rearrangement, each of said playing pieces having a groove with an inlet and an outlet, one of said playing pieces further having a through hole connecting its said groove to said lower compartment, by rearranging said playing pieces, said inlet or outlet of one of said playing pieces being capable of communicating selectively with said outlet or inlet of another of said playing pieces; and a rolling piece received in said groove of one of said playing pieces and moveable from one of said grooves to the other and then finally to said through hole.

3. A puzzle as claimed in claim 2, wherein said playing pieces are hexahedral and disposed side by side adjacent to each other, said groove of each of said playing pieces being formed in the top side of said playing piece, said outlet and inlet of each of said groove being disposed respectively at two adjacent sides of said playing piece.

4. A puzzle board as claimed in claim 3, wherein said board further includes ramp means for moving said rolling piece from said lower compartment to one of said grooves.

5. A puzzle board comprising:

a board having a first rectangular recess opening at the top side thereof, a second rectangular recess side by side adjacent to said first recess and opening at the top side of said board, a partition separating said first and second recesses and having a first opening communicating a lower part of said first recess and said second recess and a second opening communicating an upper part of said first recess and said second recess, and an inclined face extending in said second recess from said first opening to said second opening;

a rectangular plate mounted in said first recess to partition said lower and upper parts as a lower compartment and an upper compartment, and having playing piece bearing regions arranged in adjacent rows and apertures provided in each of said regions to communicate said lower and upper compartments;

playing pieces superimposed on said regions respectively except for one of said regions being left empty to allow said playing pieces to slide on said plate for rearrangement, each of said playing pieces having a groove with an inlet and an outlet, one of said playing pieces further having a through hole communicating said groove thereof to said lower compartment, by rearranging said playing pieces, said inlet or outlet of one of said playing pieces being capable of communicating selectively with said outlet or inlet of another one of said playing pieces; and a rolling piece received in said groove of one of said playing pieces and movable from one of said grooves to the other, from said grooves to said lower compartment, from said lower compartment to said second recess and then back to said grooves.

6. A puzzle board as claimed in claim 5, wherein said playing pieces are hexahedral and disposed side by side adjacent to each other, said groove of each of said playing pieces being formed in the top side of said playing piece, said outlet and inlet of each of said grooves being disposed respectively at two adjacent sides of said playing piece.

7. A puzzle board as claimed in claim 6, wherein said board further includes a transparent cover at the top of said board.

8. A puzzle board as claimed in claim 7, wherein said one of said playing piece having said through hole is fixed to the plate.

9. A puzzle board as claimed in claim 8, further comprises a valve means to interrupt the communication between said through hole and said lower compartment.

* * * * *